United States Patent [19]

Stewart et al.

[11] 4,184,619

[45] Jan. 22, 1980

[54] CUTTING DEVICE

[75] Inventors: David B. Stewart, Angus, Scotland; Edward G. Preston, Deptford, England

[73] Assignee: Wm. R. Stewart & Sons (Hacklemakers) Limited, Dundee, Scotland

[21] Appl. No.: 862,095

[22] Filed: Dec. 19, 1977

[30] Foreign Application Priority Data

Dec. 22, 1976 [GB] United Kingdom ..... 53516/76

[51] Int. Cl.[2] ..... B26F 3/02; B26F 1/24

[52] U.S. Cl. ..... 225/94; 83/345; 83/347; 83/659; 83/660; 225/97; 225/100

[58] Field of Search ..... 83/660, 30, 659, 346, 83/347, 345, 2, 658, 659, 344, 678; 225/97, 4, 96, 100

[56] References Cited

U.S. PATENT DOCUMENTS

| | | | |
|---|---|---|---|
| 245,149 | 8/1881 | Fowler | 83/658 X |
| 1,714,583 | 5/1929 | Anthony | 83/344 |
| 2,429,944 | 10/1947 | Rayburn et al. | 225/100 X |
| 3,302,501 | 2/1967 | Greene | 83/30 |
| 3,565,308 | 2/1971 | Slack | 225/97 |
| 3,618,436 | 11/1971 | Brown | 83/659 X |
| 3,747,817 | 7/1973 | Klaase | 83/660 X |

FOREIGN PATENT DOCUMENTS

| | | | |
|---|---|---|---|
| 547631 | 9/1942 | United Kingdom | 83/345 |

*Primary Examiner*—J. M. Meister
*Attorney, Agent, or Firm*—Diller, Ramik & Wight

[57] ABSTRACT

A cutting device for cutting sheets of material wherein a cutting member co-operates with a bed of upstanding pins which support the sheet. Although the cutting member may be a knife, it is preferably composed of a line of upstanding pins which are sufficiently long to penetrate through the material to be cut and to enter the bed of upstanding pins. The cutting device may comprise two drums mounted for rotation in opposite senses about parallel axes, one drum carrying the cutting member and the other the bed of pins, the tips of the pins being aligned with the cylindrical surface of their associated drum.

19 Claims, 3 Drawing Figures

CUTTING DEVICE

This invention relates to cutting devices.

One conventional type of cutting device which is used to cut strips of sheet material such as paper into short lengths comprises a cutting member, usually a blade, which cooperates with a solid anvil, usually of hardened steel, to cut a sheet of the material supported on the anvil. These devices are capable of operating at high cutting frequencies but require extremely accurate adjustment of the blade and anvil. If the blade is set too close to the anvil it becomes blunt very quickly; if the spacing between the blade and the anvil is too great, the sheet is not properly severed. Even with the optimum setting of the blade and anvil, the blade requires frequent replacement and sharpening, and the device is noisy in operation at high speeds.

Broadly in accordance with the present invention we provide a cutting device in which a cutting member cooperates with a bed of upstanding pins to cut a sheet of material supported on the bed.

In view of the fact that the bed is composed of upstanding pins, the cutting member may penetrate into the bed without damaging its cutting edge. The adjustment of the cutting device is therefore less critical than in a device which includes a solid anvil. In addition, the cutting device is less susceptible to wear and is quieter in operation.

Although the cutting member may be in the form of a continuous blade, it is preferably composed of a line of upstanding pins. The lengths of the pins in the cutting member will depend on the thickness of the material to be cut. Thus, the pins should be sufficiently long to penetrate through the material to be cut and to enter the bed of upstanding pins. The pins in the bed will usually be arranged in a series of parallel lines, although a random array may be used. The spacings between the pins should be sufficiently small to support a sheet of material without perforating the sheet. The maximum possible spacing between the pins will therefore be determined by the resilience of the material to be cut. Thus, in one embodiment of the invention relatively thin paper (e.g. two thousanths of an inch in thickness), was successfully severed using an array of pins having 40 lines of pins per inch, each line containing 40 pins per inch. In general, closer spacing of the pins in the cutting member improves the uniformity of the cut produced.

The pins of the bed are preferably more flexible than those of the cutting member so that penetration of the cutting member into the bed causes deflection of the pins in the bed rather than of the pins in the cutting member. Thus, the pins in the bed are generally longer than those in the cutting member. Additionally, or alternatively the pins in the bed may be of greater cross-sectional area than the pins in the cutting member. For example, in one cutting device suitable for paper two thousanths of an inch in thickness, the pins project ½ inch from the base of the cutting bed and are made of wire having a diameter of 15 thousanths of an inch.

The bed of pins may be manufactured by securing the pins in a suitable supporting maxtrix. For example the matrix may be a plate or sheet of metal, the pins being located in holes in the sheet or plate. The pins may be interference fitted into the holes in the sheet or plate, or may be secured in the holes by soldering or by any of the techniques conventionally used in the manufacture of textile carding, fibrillating or combing equipment.

One particularly suitable technique for securing the pins in the matrix is disclosed and claimed in our British Patent specification No. 1298561.

The space between the pins may be wholly or partly filled by an elastic medium, for example a natural or synthetic rubber or other resiliently deformable plastics material. This material prevents ingress of foreign matter between the pins whilst still allowing the pins to move relative to each other when the cutting member penetrates into the bed. If desired the supporting matrix of the pins may be constituted solely by the elastic filler medium. The filler medium may surround the whole lengths of the pins in the bed. However, since the exposed surface of the filler material would rapidly become worn during use, it is preferably that the tips of the pins be spaced from the surface of the filler material. Preferably therefore about three quarters of the lengths of the pins are surrounded by the filler material so that, for example, in an array composed of pins of ½ inch in length the tips of the pins lie about ⅛th inch above the surface of the filler material.

The cooperation of the cutting member and the bed may be effected by movement of either one or both the cutting member and bed. The movement may be a linear reciprocation or a rotational movement. In a preferred embodiment, the cutting member and bed are mounted for rotation about respective parallel axes, the pins of the bed and, if present, the cutting member, extending in radial directions from the respective axes. Thus, the cutting device may comprise two drums mounted for rotation in opposite senses about parallel axes, one of the drums carrying the cutting member, the other drum carrying the bed of pins. The tips of the pins of the bed will generally be aligned with the cylindrical surface of the drum and the cutting member will project from the drum in which it is mounted.

In general the cutting member will be so disposed relative to the bed that the sheet is cut at right angles across the sheet. If desired however, the cutting member and bed may be arranged to produce an angled cut or a curved cut. Thus, the cutting member may be disposed helically on the surface of a cutting drum, the circumferential length of the bed on the other drum being sufficient to accommodate the length of the cutting member as the two drums rotate.

The cutting device is preferably associated with a conventional feed mechanism which may be used to control the rate at which material is fed to the cutting device. Thus, when the cutting member and the bed are arranged for rotation about parallel axes, the material may be fed to the drums at a speed lower than the speed of the cutting member and bed so that the cutting member and bed exert a pulling action on the material as the cut is made, facilitating separation of the severed portion of the sheet. Alternatively this pulling action may be performed by a separate pair of drawing rollers downstream from the cutting device.

A series of cutting elements and beds may be provided on the drums of the cutting device so that the device makes more than one cut on each revolution of the drum. Alternatively, the bed itself may be in the form of a cylindrical array of upstanding pins so that the same bed may be with any number of cutting elements on the other drum.

One embodiment of a cutting device in accordance with the invention will now be described, by way of example only, with reference to the accompanying drawings, in which.

Figure 1:
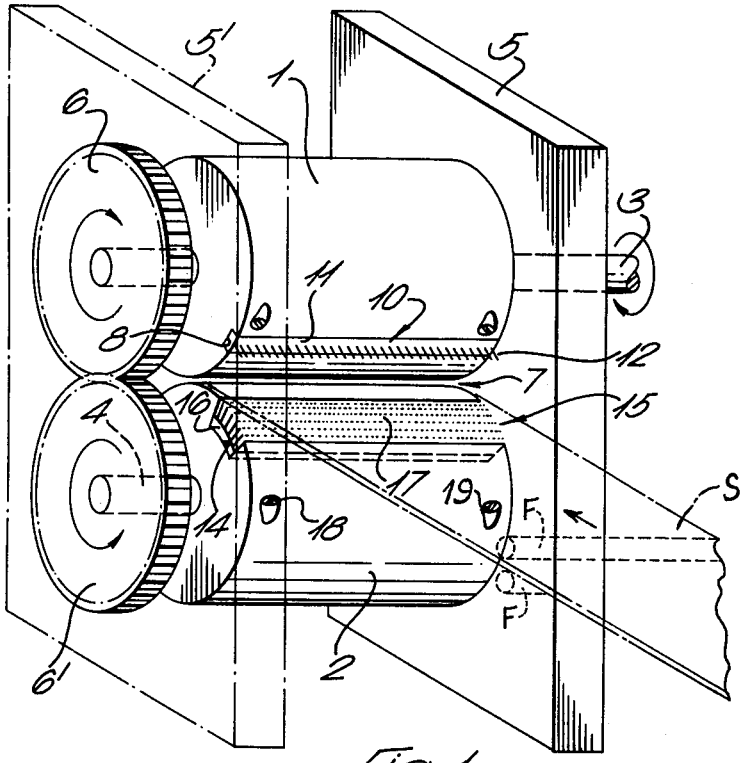
FIG. 1 is a perspective view of the cutting device.

Referring to the drawings, the cutting device comprises first and second drums, 1 and 2, rotatably mounted on axles 3, 4 in side frames 5,5'. The axles 3, 4 carry gear wheels 6, 6' which intermesh so that a drive can be transmitted from the axle 3 of the first drum 1 to the axle 4 of the second drum 2. The peripheral surfaces of the drums are spaced apart to define a gap 7 through which a sheet S of material to be cut may be fed.

Figure 2:
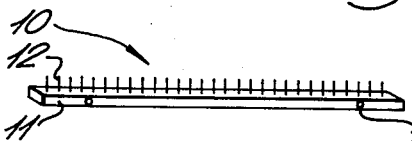
FIG. 2 is a perspective view of a cutting member incorporated in the device.

An axially extending recess 8 in the circumferential surface 9 of the first drum 1 houses a cutting member 10 which is illustrated in more detail in FIG. 2.

The cutting member 10 comprises a base 11 in which a single line of upstanding pins 12 are secured. The pins 12 may be secured in the base 11 by soldering, interference fitting or by an adhesive in the manner described in our British Patent specification No. 1298561. The base 11 of the cutting member 10 includes two apertures 13 which register with two threaded apertures drilled chordally in the drum 1 so that the cutting member 10 may be bolted into the recess 8 in the drum 1. When mounted in the drum, the pins 12 of the cutting member project from the peripheral surface of the first drum 1 by a distance greater than the width of the gap 7 between the peripheral surfaces of the two drums 1 and 2.

Figure 3:
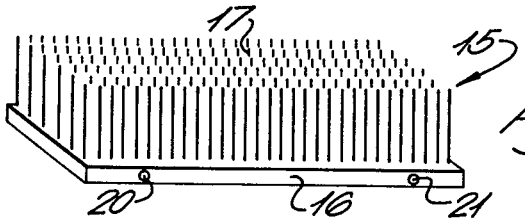
FIG. 3 is a perspective view of a bed of upstanding pins incorporated in the device.

An axially-extending recess 14 is also defined in the surface of the second drum and houses a bed 15 of upstanding pins, as illustrated in FIG. 3.

The bed 15 comprises a rectangular base 16 in which six lines of upstanding pins 17 are secured for example by brazing, soldering or an adhesive. The pins 17 are longer than the pins 12 of the cutting member 10 and form a closely packed array. The bed is secured in the second drum by two bolts 18, 19 which pass through two threaded holes in the drum 2 and two holes 20, 21 in the base 16 of the bed 15. The pins 17 are all of the same length so that when the bed is located in the recess 14 the tips of the pins form a continuation of the circumferential surface of the second drum 2. Base 16 may be flat or curved.

The relative positions of the cutting member 10 and the bed 15 on the drums 1 and 2 are such that when the drums are rotated the bed 15 registers with the cutting member 10 as they pass through the gap 7, and the pins 11 of the cutting member 10 project into the central region of the bed 15.

In use, the first and second drums 1 and 2 are driven in opposite directions by rotating the axle 3 of the first drum 1 in the direction indicated by the arrow in FIG. 1. A strip of material to be cut, such as paper, is then fed into the gap 7 between the two drums 1 and 2 by a feed mechanism F, which may be, for example, a conventional set of feed rolls, the feed mechanism preferably being arranged to pass the material through the gap 7 at a speed slower than the speed at which the bed 15 and cutting member 10 pass through the gap 7.

When the cutting member 10 and the bed 15 pass through the gap, the pins 12 of the cutting member pass through the material into the bed 15. The spacing of the pins 12 is such that a single cut is produced across the whole width of the material, the material adjacent the cutting member being supported by the bed 15.

In view of the fact that the speed of the cutting member 10 and bed 15 is greater than the rate of feed of the material into the gap 7, the pins of the cutting member exert a pulling force on the material, thereby facilitating the separation of the severed section from the rest of the material.

In order to increase the number of cuts made by the machine per length of material fed to it, the rate of rotation of the drums may be increased, or the feed rate of the material may be decreased. Alternatively, the drums may be provided with two or more beds and cutting members. The apparatus therefore enables a strip of material to be cut into sections with extreme ease and without requiring accurate adjustment of the cutting member 10 and the bed 15. Moreover the cutting member 10 can be replaced quickly and easily, and the operation of the machine is relatively silent even at high speeds.

What we claim is:

1. A cutting device for cutting a sheet material web of indeterminate length generally transversely of its length comprising a pair of members defining therebetween a gap through which a sheet material web of indeterminate length is adapted to pass, means for imparting opposite relative rotational motion to said pair of members for progressively decreasing the size of said gap during the passage of the web therebetween and impart a predetermined linear speed to said web as the latter departs said gap, means for feeding a sheet material web of indeterminate length to said gap, a first of said pair of members carrying narrow linear cutting means disposed transversely of the length of the web and projecting toward a second of said pair of members during the decreasing in size of said gap for cutting completely through the web transversely thereof to form only a generally narrow cut line thereacross, said narrow linear cutting means being a plurality of first pins whereby the narrow cut line is a line of perforations, said second member carrying a plurality of closely spaced at least partially circumferentially extending second pins disposed transversely of the length of the web and projecting toward said first member during the decreasing in size of said gap for receiving therebetween said linear cutting first pins and supportingly backing-up the web during the transverse cutting thereof whereby the web can be separated into discrete lengths along the narrow cut line, and said feeding means feed said web to said gap at a linear speed with is slower than said predetermined speed whereby the combined movement of said first and second pins exert a pulling action on said web during the perforation thereof to facilitate the separation of said web along said line of perforations.

2. The cutting device as defined in claim 1 wherein said second pins are arranged in a series of parallel lines, and there are forty (40) lines of said second pins per inch with each line containing forty (40) pins per inch.

3. The cutting device as defined in claim 1 wherein said second pins are arranged in a random array.

4. The cutting device as defined in claim 1 wherein said second pins are more flexible than said first pins.

5. The cutting device as defined in claim 1 wherein said first pins are shorter than said second pins.

6. The cutting device as defined in claim 1 wherein said first pins are of lesser individual cross-sectional area than that of said second pins.

7. The cutting device as defined in claim 1 wherein said second pins are more flexible and longer than said first pins.

8. The cutting device as defined in claim 1 wherein said second pins are longer and are of greater individual cross-sectional area than that of said first pins.

9. The cutting device as defined in claim 1 wherein said second pins are more flexible, longer and of greater individual cross-sectional area than that of said fist pins.

10. The cutting device as defined in claim 1 wherein said second pins are more flexible and are of greater individual cross-sectional area than that of said first pins.

11. The cutting device as defined in claim 1 wherein said first and second members include opposing respective first and second generally cylindrical surfaces, said first pins project beyond the plane of said first surface, and said second pins terminate in tips lying generally in the plane of said second surface.

12. The cutting device as defined in claim 11 wherein said second pins are arranged in a series of parallel lines, and there are forty (40) lines of said second pins per inch with each line containing forty (40) pins per inch.

13. The cutting device as defined in claim 11 wherein said second pins are more flexible than said first pins.

14. The cutting device as defined in claim 11 wherein said first pins are shorter than said second pins.

15. The cutting device as defined in claim 11 wherein said first pins are of lesser individual cross-sectional area than that of said second pins.

16. The cutting device as defined in claim 11 wherein said second pins are more flexible and longer than said first pins.

17. The cutting device as defined in claim 11 wherein said second pins are longer and are of greater individual cross-sectional area than that of said first pins.

18. The cutting device as defined in claim 11 wherein said second pins are more flexible, longer, and of greater individual cross-sectional area than that of said first pins.

19. The cutting device as defined in claim 11 wherein said second pins are more flexible and are of greater individual cross-sectional area than that of said first pins.

* * * * *